United States Patent [19]

Alpert

[11] Patent Number: 5,031,806

[45] Date of Patent: Jul. 16, 1991

[54] SLIP-RING FOR DONNING OF SURGICAL STOCKINGS

[76] Inventor: Gerald Alpert, 1 Nancy Ct., Huntington, N.Y. 11743

[21] Appl. No.: 411,931

[22] Filed: Sep. 25, 1989

[51] Int. Cl.[5] ..... A47G 25/90

[52] U.S. Cl. ..... 223/112; 223/111

[58] Field of Search ..... 223/111, 112; 63/DIG. 3, 3

[56] References Cited

U.S. PATENT DOCUMENTS

| | | | |
|---|---|---|---|
| 217,061 | 7/1879 | Chapman | 63/3 |
| 2,443,115 | 6/1948 | Park | 223/111 |
| 2,796,207 | 6/1957 | Young | 223/111 |
| 3,070,271 | 12/1962 | Kennedy | 223/111 |
| 3,097,644 | 7/1963 | Parker | 128/157 |
| 3,227,335 | 1/1966 | Minnema | 223/111 |
| 3,237,821 | 3/1966 | Hayne | 223/111 |
| 3,968,792 | 7/1976 | Small | 128/132 D |
| 4,072,255 | 2/1978 | Bogorad | 223/111 |
| 4,153,054 | 5/1979 | Boone | 128/132 D |
| 4,159,069 | 6/1979 | Poncy et al. | 223/111 |
| 4,275,812 | 6/1981 | Poncy et al. | 206/278 |
| 4,308,864 | 1/1982 | Small et al. | 128/132 D |
| 4,357,694 | 11/1982 | Montuori | 63/3 |
| 4,497,424 | 2/1985 | Smith | 223/111 |
| 4,516,704 | 5/1985 | Hagman | 223/111 |

*Primary Examiner*—Werner H. Schroeder
*Assistant Examiner*—Bibhu Mohanty
*Attorney, Agent, or Firm*—Nolte, Nolte and Hunter

[57] ABSTRACT

A rigid, specially molded and elliptical or egg-shaped ring is used to facilitate the donning of surgical stockings. An egg-shaped or elliptical ring of a slightly larger diameter than that of the calf size, can be simply inserted, tapered end first, and positioned laterally in the stocking in order to enlarge the ankle area, thereby allowing the foot to be easily inserted. The ring is used to laterally position the stocking, and the toe of the stocking is pulled through the ring. The stocking may then be drawn upon the leg by holding the sides of the ring, and pulling the stocking up while simultaneously extending the leg in a downward position. Subsequently, the ends of the stocking are pulled over the ring which is automatically released from the stocking and easily removed. Physical strain usually experienced after surgery or in other medical conditions is reduced.

5 Claims, 3 Drawing Sheets

SLIP-RING FOR DONNING OF SURGICAL STOCKINGS

FIELD OF THE INVENTION

This invention relates to a device and method in conjunction therewith for the donning of surgical or elastic stockings thereby reducing strain and the force otherwise required in such process.

1. Background of the Invention

As distinguished from ordinary hosiery, surgical or elastic stockings are manufactured of a tightly knit or woven elastic material so as to furnish support and allow proper blood circulation when worn. They are used frequently upon medical prescription in post-operative case and particularly after coronary by-pass surgery. They are generally, by nature and design, so tightly woven that they are difficult to don. When a wearer is invalid as post surgery patients often are, the stockings are particularly difficult to put on.

2. The Prior Art

There are several devices which are distinguishable from the present invention by design and purpose. Such devices deal with the donning of "hosiery" used in ordinary wear as distinguished from that used in post operative conditions or where medical prescription is otherwise indicated.

One shown in A. H. Young U.S. Pat. No. 2,796,207, for STOCKING-APPLYING DEVICE, refers to an open ended, semi rigid, open-faced sleeve with tapes attached to one end. The stocking is placed over the untaped end and is attached to the top of the sleeve. The foot is inserted into the sleeve and by pulling on the cloth tapes the sleeve is removed and the sock or stocking remains in place on the leg. This is designed for infirm or elderly persons who cannot bend over to put on socks or stockings.

Another device, Harry C. Hagman U.S. Pat. No. 4,516,704, for HOSIERY DONNING AID, to aid the infirm in donning hosiery, comprises a hoop with a circumference larger than the leg to be inserted therein, and a telescopic rod attached to one side of the hoop. By placing the top open stocking over the hoop, inserting the foot into the loosely fit hoop and pulling the extended rod, the stocking is pulled onto the leg and the hoop and rod are then removed.

The foregoing inventions for the donning of loose or form fitting hosiery have the purpose of avoiding bending to don stockings. The present invention is clearly distinguishable in that the stocking to be donned is of a special tightly woven elastic fabric which is structurally different from that used in conventional or ordinary hosiery. The inventions referred to could not be used for the purpose served by the current invention and method.

Another is shown in Poncy et al U.S. Pat. No. 4,275,812, for SURGICAL GLOVE PACKAGE AND DONNING METHOD and is comprised of a liner attached to the surgical glove which permits placement of the glove upon the surgeon's hand as a method of avoiding contamination. The outer surface of the glove is stretched around the axial end of a packaging ring having a bag sealed to the ring to protect the outer surface.

Still another device is found in a SURGICAL GLOVE PACKAGE, Poncy et al U.S. Pat. No. 4,159,069, wherein the cuff of an elastometric glove is stretched around a D-shaped packaging ring having a liner attached to it which is used to remove the ring after the glove is donned.

Other devices deal with surgical dressings, bandages and casts which are sterilized, pretreated and rolled onto rings or hoops which are then applied to arms and legs by rolling the dressing bandages or casts onto the extremity and thereby avoiding the usual process of such applications. Reference thereto is found in L. O. Parker U.S. Pat. No. 3,097,644, for TUBULAR SURGICAL BANAGES, CASTS, AND MOLDS.

In the matter of the foregoing and inventions cited for use in the application of surgical dressings, bandages, casts or gloves, such inventions are clearly distinguishable and unrelated in concept or purpose from those set forth in this invention. The substantially elliptical or substantially-shaped ring device in this invention is also different in configuration and design from the circular or D-shaped hoops referred to in the prior art.

SUMMARY OF THE INVENTION

The invention is comprised of an egg-shaped rigid ring, slightly larger in diameter than the diameter of the calf of the wearer of the stocking to be donned. By inserting the ring at the tapered end into the stocking and positioning it laterally above the ankle area, thereby enlarging the opening, the toe of the stocking having first been pulled through the ring, the foot may then be properly positioned in the toe of the stocking. By grasping both sides of the ring it may be pulled upon the leg while simultaneously extending the leg. The stocking then pulled over the ring automatically releases it and the ring easily slides off the leg.

BRIEF DESCRIPTION OF THE DRAWINGS

The invention is illustrated by the accompanying schematic drawings.

DETAILED DESCRIPTION OF THE DRAWINGS

Figure 1:
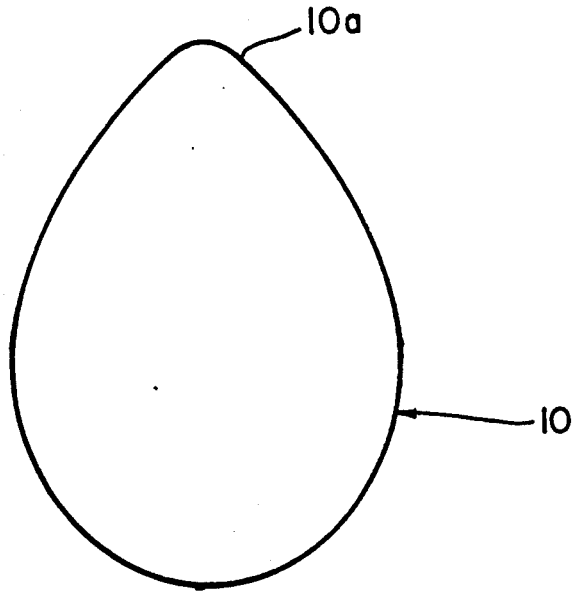
FIG. 1 is a perspective view of the elliptical or egg-shaped ring.
Figure 3:
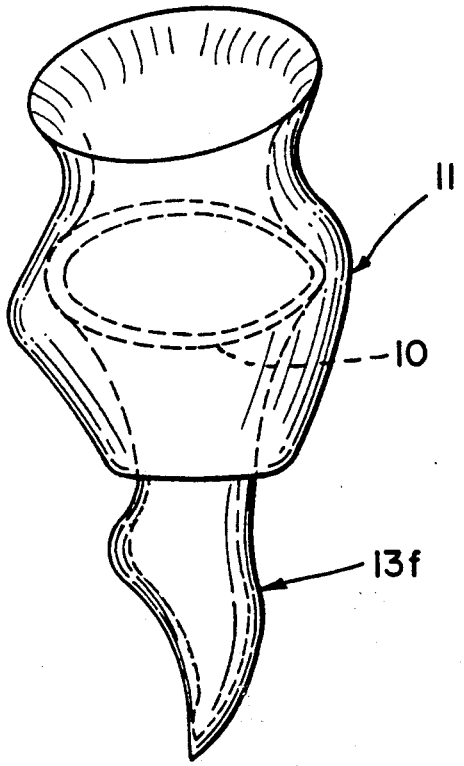
FIG. 3 is a perspective view of the stocking pulled over the ring and overlapping the calf part of the stocking.
Figure 2:
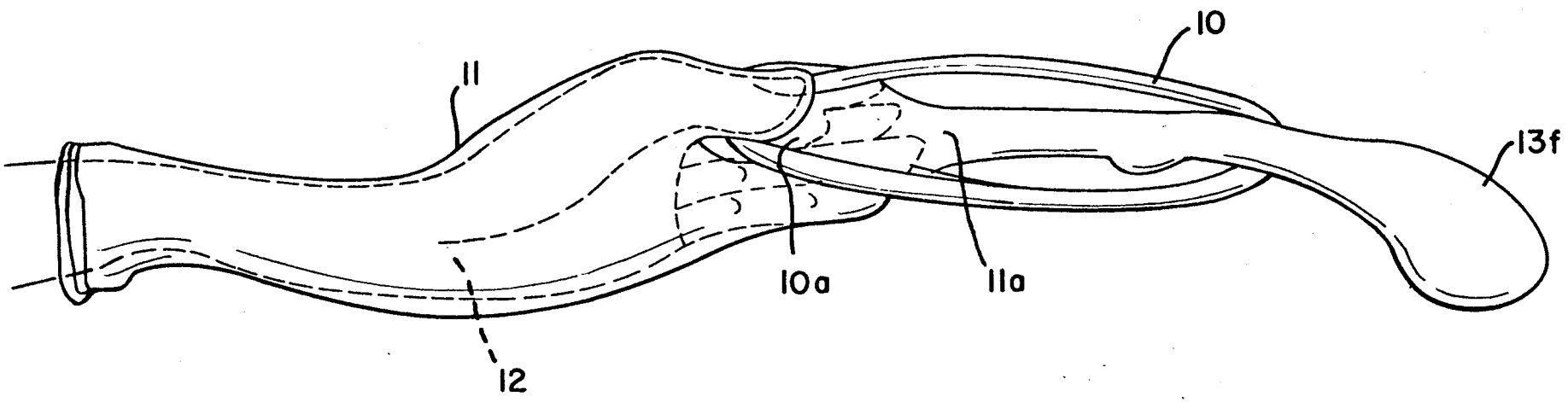
FIG. 2 is a perspective view of the hand inserted into the stocking and holding the tapered end of the ring, showing the toe end of the stocking pulled through and over the top of the ring.
Figure 5:
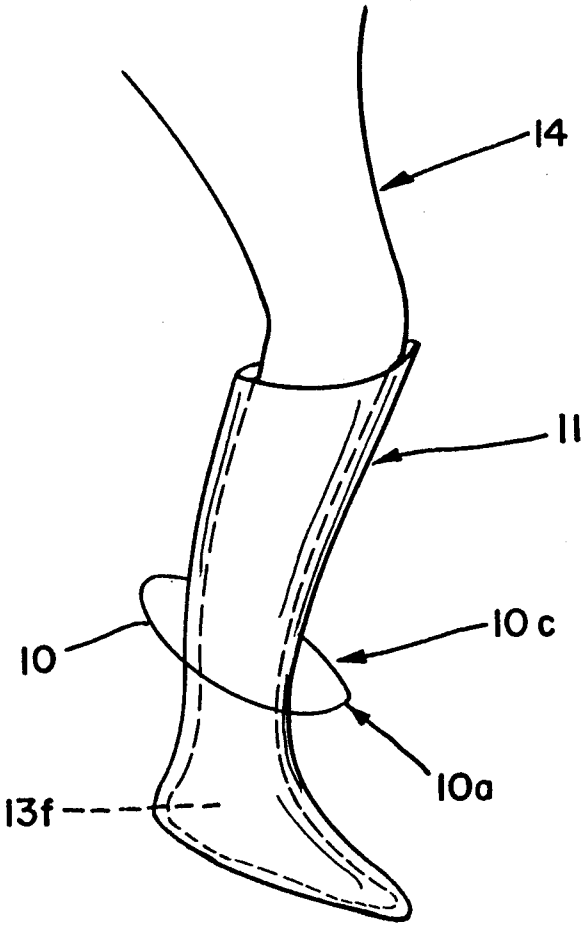
FIG. 5 is a perspective view of the stocking pulled onto the leg and the ring released from its former position ready to be removed from the leg.
Figure 4:
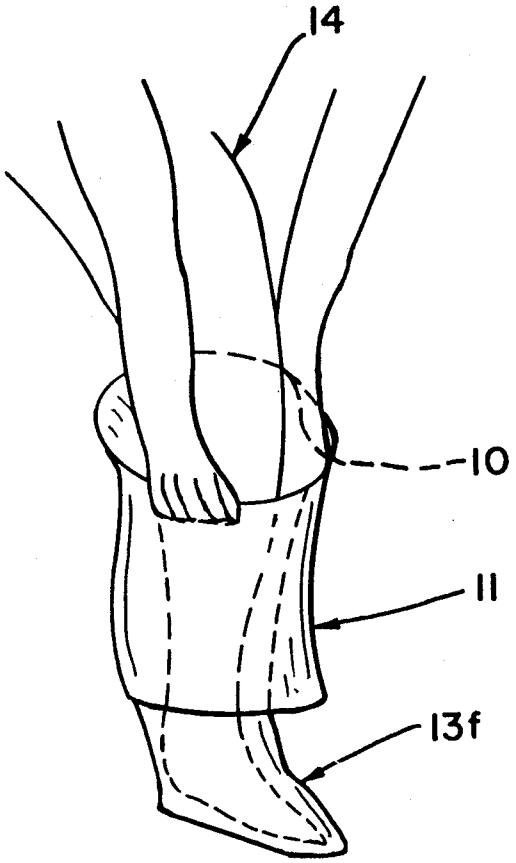
FIG. 4 is a perspective view of the foot and leg inserted into the stocking, the hands grasping the sides of the ring and stocking for pulling up the stocking, with the leg extended.

As shown in FIG. 1, this invention is comprised of a device in the form of either a substantially elliptical or, preferably, a substantially egg-shaped ring 10 with an apex 10*a* at one end thereof and a semi-circular portion at the other end, and method used in conjunction therewith to aid in the donning of surgical or elastic stockings 11 (FIG. 2). As distinguished from conventional hosiery, surgical or elastic stockings are woven of a tightly knit elastic fabric which has a constricted top opening, ankle and calf diameter requiring the application of force and strain in the donning of such stockings 11. This invention helps reduce such force and strain by means of leverage applied in the use of the egg-shaped ring 10. The method used with this invention is as follows:

First insert the hand 12 (FIG. 2) into the stocking to a point 11*a* in the intermediate tubular portion thereof between the open end of the stocking and the closed heel and foot end. Externally hold the apex 10*a* of the ring through the stocking and draw the toe end of the stocking through the ring. The stocking is then pulled off the hand and over ring 10. Ring 10 is then positioned laterally in the stocking as shown in FIG. 3 to provide an extended and less restricted opening, through which the heel and toe end 13*f* of the stocking is then inserted and positioned in the toe of stocking 11 (FIG. 4). By grasping both sides of the ring-engaged stocking (FIG. 4) the stocking 11 is then pulled onto the leg. Stocking 11 is then pulled over the ring 10 (FIG. 5). Removing stocking 11 from ring 10 automatically releases ring 10 which slides freely off leg 14. The egg-shaped ring 10 is of a smooth, rigid plastic or metallic material so designed as to reduce friction when inserted at the tapered end with apex 10*a* thereof into the opening of the stocking.

I claim as my invention:

1. A stocking donning device for use by a person to don a surgical or elastic stocking easily and with reduced strain, the stocking having an open end, a closed heel and toe end, an intermediate tubular portion therebetween and outer and inner surfaces for fitting the calf, ankle and foot of the person with the inner surface tightly thereagainst said device comprising a body describing and consisting of an egg-shaped ring having a larger semi-circular end and a tapered end including an apex, said larger semi-circular portion of said ring having an inner peripheral circumference conforming to but slightly larger than the widest diameter of a calf portion of the leg of the person donning the stocking, said apex of said tapered portion comprising the sole means for grasping said ring when a hand of a person donning the stocking is inserted through the open end of the stocking, and the intermediate portion of the stocking in adjacency with said apex, said body being continuous and devoid of appendages so as to constitute said ring as means for receiving the heel and toe end of the stocking therethrough while said apex thereof is being grasped by the hand of the person, and so as to constitute said tapered end and apex of said ring a circumferential portion diminished in size as means for facilitating a drawing, of the remainder of a portion of the stocking extending toward the open end thereof from the position at which the apex is grasped with a minimum of friction off the hand of the person and around the periphery of the ring with the outside surface of the stocking in adjacency with the circumference of the ring for spreading the lateral width of the stocking to receive the foot of the person.

2. The device according to claim 1, in which the ring is comprised of tubing.

3. The device according to claim 2, constructed of rigid plastic.

4. The device according to claim 2, constructed of wire.

5. A method of donning a surgical or elastic stocking having an open end, a closed heel and toe end, an intermediate tubular portion therebetween and outer and inner surfaces with a slip ring circumferentially formed with an apex at one end comprising the steps of:

inserting a hand into the stocking to the intermediate area above the heel and foot end;

externally holding the apex of the ring through the stocking;

drawing the heel and toe end of the stocking through the ring;

pulling the stocking off the hand and over the ring;

positioning the ring laterally with the stocking thereabout to provide an extended and less restricted opening;

grasping both sides of the ring-engaged stocking;

inserting the foot through the ring and positioning it in the toe of the stocking;

pulling said ring-engaged stocking onto the leg; and pulling the stocking over the ring onto the upper portion of the leg and thereby releasing the ring from the stocking.

* * * * *

UNITED STATES PATENT AND TRADEMARK OFFICE

CERTIFICATE OF CORRECTION

PATENT NO. : 5,031,806

DATED : July 16, 1991

INVENTOR(S) : Gerald Alpert

It is certified that error appears in the above-identified patent and that said Letters Patent is hereby corrected as shown below:

Column 3, line 13, delete "heel and toe end 13f of the stocking" and insert --foot--.

Signed and Sealed this

Fifth Day of May, 1992

*Attest:*

DOUGLAS B. COMER

*Attesting Officer*

*Acting Commissioner of Patents and Trademarks*